United States Patent [19]

Fujieda et al.

[11] Patent Number: 4,791,903

[45] Date of Patent: Dec. 20, 1988

[54] FUEL SUPPLY SYSTEM FOR INTERNAL-COMBUSTION ENGINE

[75] Inventors: Mamoru Fujieda, Ibaraki; Yoshishige Oyama, Katsuta, both of Japan

[73] Assignee: Hitachi, Ltd., Tokyo, Japan

[21] Appl. No.: 126,344

[22] Filed: Nov. 30, 1987

Related U.S. Application Data

[63] Continuation of Ser. No. 474,033, Mar. 10, 1983, abandoned.

[30] Foreign Application Priority Data

Mar. 10, 1982 [JP] Japan ..... 57-32514

[51] Int. Cl.[4] ..... F02M 39/00

[52] U.S. Cl. ..... 123/472; 123/52 MV; 123/285

[58] Field of Search ..... 123/285, 472, 283, 52 MV, 123/52 MB

[56] References Cited

U.S. PATENT DOCUMENTS

| | | | |
|---|---|---|---|
| 2,766,743 | 10/1956 | Platner | 123/52 MV |
| 2,989,956 | 6/1961 | Dinkard | 123/52 MV |
| 3,113,561 | 12/1963 | Heintz | 123/283 |
| 4,240,387 | 12/1980 | Montosubi | 123/52 MB |
| 4,323,041 | 4/1982 | Endo | 123/472 |
| 4,361,126 | 11/1980 | Knapp | 123/472 |
| 4,366,789 | 1/1983 | Eckert | 123/285 |
| 4,455,975 | 6/1984 | Kume | 123/52 MV |

*Primary Examiner*—Carl Stuart Miller

*Attorney, Agent, or Firm*—Antonelli, Terry & Wands

[57] ABSTRACT

A fuel supply system for internal-combustion engine, with a fuel supply arrangement disposed at such a position that the relationship between the volume $V_{COM}$ of a combustion chamber and the volume $V_{IN}$ of an intake-air passage between an intake valve and the fuel supply arrangement satisfies the condition $V_{IN}/V_{COM}=0.7$ to 1.2. Thereby, the air present between the vicinity of an intake valve and the fuel supply arrangement is drawn into, in accordance with the progress of the intake stroke, and the fuel supplied by the fuel supply arrangement is concentrated in a vicinity of an ignition plug in the combustion chamber upon the completion of the intake stroke.

5 Claims, 3 Drawing Sheets

| | | | | | |
|---|---|---|---|---|---|
| # 1 | INTAKE | COM-PRESSION | COM-BUSTION | EXHAUST | INTAKE |
| # 3 | EXHAUST | INTAKE | COM-PRESSION | COM-BUSTION | EXHAUST |
| # 4 | COM-BUSTION | EXHAUST | INTAKE | COM-PRESSION | COM-BUSTION |
| # 2 | COM-PRESSION | COM-BUSTION | EXHAUST | INTAKE | COM-PRESSION |

| | | | | | |
|---|---|---|---|---|---|
| # 1 | INTAKE | COM-PRESSION | COM-BUSTION | EXHAUST | INTAKE |
| # 3 | EXHAUST | INTAKE | COM-PRESSION | COM-BUSTION | EXHAUST |
| # 4 | COM-BUSTION | EXHAUST | INTAKE | COM-PRESSION | COM-BUSTION |
| # 2 | COM-PRESSION | COM-BUSTION | EXHAUST | INTAKE | COM-PRESSION |

FUEL SUPPLY SYSTEM FOR INTERNAL-COMBUSTION ENGINE

This is a continuation application of Ser. No. 474,033, filed Mar. 10, 1983, now abandoned.

BACKGROUND OF THE INVENTION

1. Field of the Invention

The present invention relates to a fuel supply system for internal-combustion engine and, more particularly, to a fuel supply system for internal-combustion engine arranged such that a richer air-fuel mixture is supplied to the vicinity of an ignition plug in a combustion chamber defined by a cylinder and a piston.

2. Description of the Prior Art

It has been generally known that operating internal-combustion engines on a lean air-fuel mixture is effective in reducing the fuel consumption as well as the amount of noxious components in the exhaust gas.

Such internal-combustion engines employing a lean air-fuel mixture require making the air-fuel mixture in the vicinity o the ignition plug richer than that surrounding the same in order to ensure the ignitability of the air-fuel mixture.

Therefore, in, for example, U.S. Pat. No. 3,842,810 a method has been proposed in which an auxiliary combustion chamber is formed separately from a main combustion chamber defined by a cylinder and a piston, and a rich air-fuel mixture is supplied to the auxiliary combustion chamber and ignited by means of an ignition plug, and then the flames of the rich air-fuel mixture are propagated to ignite a lean air-fuel mixture in the main combustion chamber.

Such a method, however, disadvantageously requires additional provision of both an auxiliary combustion chamber and an air-fuel mixture supply means for supplying a rich air-fuel mixture thereto.

SUMMARY OF THE INVENTION

It is, therefore, a primary object of the invention to provide a novel fuel supply system for internal-combustion engine requiring no auxiliary combustion chamber and no air-fuel mixture supply means therefor.

To this end, according to the invention, there is provided a fuel supply system for an internal-combustion engine arranged such that a fuel supply means is disposed at such a position that the relationship between the volume $V_{IN}$ of an intake-air passage between an intake valve disposed between a combustion chamber and the intake-air passage and the fuel supply means and the volume $V_{COM}$ of the combustion chamber satisfies the following condition: $V_{IN}/V_{COM}=0.7$ to 1.2 (i.e., $V_{IN}=0.7$ to 1.2 $V_{COM}$), whereby the air present between the vicinity of the intake valve and the fuel supply means is sucked in in accordance with the progress of the intake stroke of an internal-combustion engine, and the fuel supplied by the fuel supply means is concentrated in the vicinity of an ignition plug disposed in the upper part of a cylinder at the end of the intake stroke.

The above and other objects, features and advantages of the invention will be apparent from the following description taken in connection with the accompanying drawings.

DETAILED DESCRIPTION OF THE PREFERRED EMBODIMENTS

Figure 1:
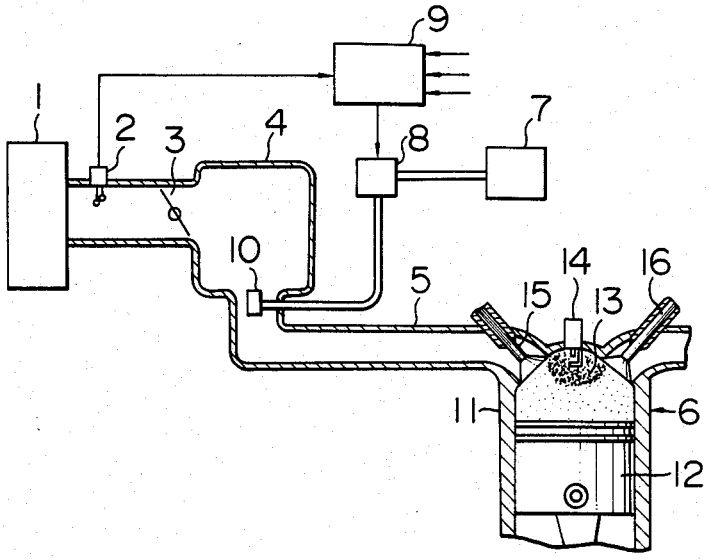
FIG. 1 is an illustration of the arrangement of a fuel supply system for internal-combustion engine in accordance with a preferred embodiment of the invention.

Referring to FIG. 1, an internal-combustion engine 6, as is generally known, comprises a plurality of combustion chambers 13 each defined by a cylinder 11 and a piston 12, and an ignition plug 14 is fixed to the upper part of each combustion chamber 13. The air necessary for combustion in the engine 6 passes out of an air cleaner 1 through an air flow detector 2 and enters an intake manifold 4 through a throttle valve 3. The intake manifold 4 is a capacity chamber for preventing the interference of the intake air and connected with intake-air passages 5 equal in number to engine cylinders 11 for supplying the air thereto. A fuel is supplied from a fuel supply device 7 to a fuel metering valve 8, with the fuel metering valve 8, being driven by an arithmetic circuit 9, and metering necessary amount of fuel. The fuel is distributed among fuel injection nozzles 10 through respective fuel supply pipes equal in number to the engine cylinders 11.

Moreover, the engine 6 is provided with an intake valve 15 and an exhaust valve 16, which are opened and closed in a predetermined timed relation to each other in synchronism with the engine rotation.

The cycle in the case of a four-cycle engine repeats intake, compression, combustion and exhaust strokes, and the air flows through the intake-air passage 5 only during the intake stroke. During the other strokes, since the intake valve 15 remains closed, the intake-air passage 5 is a baggy piping with its inlet open, so that no air flows therethrough.

On the other hand, in the embodiment shown in FIG. 1 wherein the fuel is intermittently metered, the fuel metering valve 8 supplies the fuel through the fuel injection nozzles 10 to four combustion chambers 13 in the case of a four-cylinder engine. Therefore, the fuel metering valve 8 is opened and closed in synchronism with the strokes in the combustion chambers 13.

Figure 2:
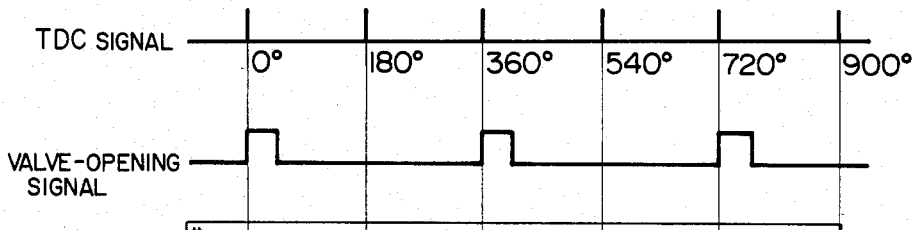
FIG. 2 shows the relationship between an injection signal in the fuel supply system shown in FIG. 1 and the stroke in each of combustion chambers.

More specifically, as shown in FIG. 2, a TDC signal (Top Dead Center signal) is delivered every 180° in the crank angle in the case of a four-cycle four-cylinder engine. The fuel metering valve 8 is driven by an valve-opening signal delivered each time two TDC signals are fed thereto. These are controlled by the arithmetic circuit 9. Here, the first cylinder #1 is under the intake stroke; the third cylinder #3 is under the exhaust stroke; the fourth cylinder #4 is under the combustion stroke; and the second cylinder #2 is under the compression stroke.

Paying attention to the first cylinder #1, therefore, the fuel injected the last time and staying in the intake-air passage 5 of the first cylinder #1 in the vicinity of the fuel injection nozzle 10 and the fuel injected this time are simultaneously sucked into the combustion chamber 13.

Also in the fourth cylinder #4, the fuel is sucked in the same manner as that in the first cylinder #1.

On the other hand, in the case of the third cylinder #3 and the second cylinder #2, the fuel injected when they are under the exhaust stroke and the compression stroke, respectively, and staying in the vicinities of the fuel injection nozzle 10 are sucked in, respectively.

Thus, the intake-air passage 5 connected to one of the combustion chambers 13 is supplied with the fuel from the fuel injection nozzle 10 during two of the intake, compression, combustion and exhaust strokes.

Next, as the intake valve 15 is opened to initiate the intake stroke, the air closer to the intake valve 15 is sucked into the combustion chamber 13 at an early stage, and thereafter the air containing the fuel near the fuel injection nozzle 10 is sucked into the combustion chamber 13.

Consequently the air-fuel mixture in the bottom part of the combustion chamber 13 (i.e., in the vicinity of the crown of the piston 12) becomes lean, since it contains more air. On the other hand, the air-fuel mixture in the upper part of the combustion chamber 13 becomes rich, since it contains more fuel. As a result, the air-fuel mixture near the ignition plug 14 becomes an ignitable mixture.

Thus, the air-fuel mixture in the combustion chamber 13 becomes a stratified mixture which is rich in the vicinity of the ignition plug 14 in the combustion chamber 13; the closer to the crown of the piston, the leaner the air-fuel mixture.

By the way, it has been confirmed that the relationship between the volume $V_{IN}$ of the intake-air passage 5 between the fuel injection nozzle 10 and the intake valve 15 an the volume $V_{COM}$ of the combustion chamber 13 is important for efficiently forming such a stratified air-fuel mixture in the combustion chamber 13.

Figure 3:
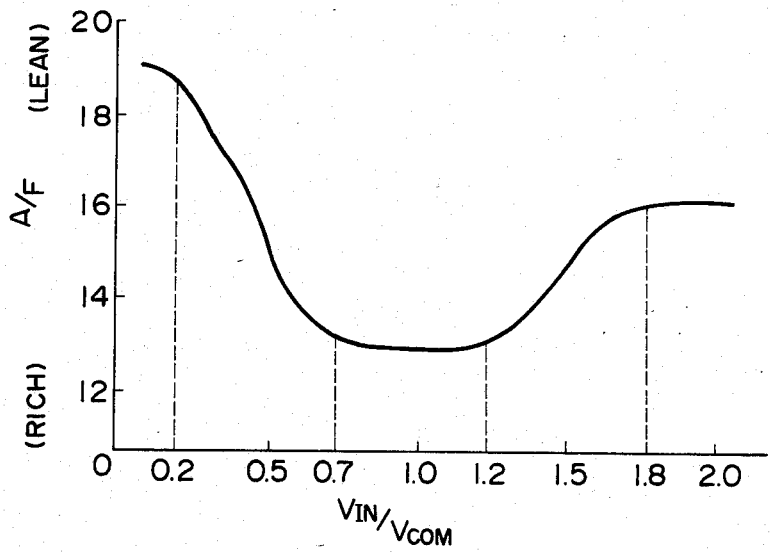
FIG. 3 shows the relationship between the ratio between the volume of an intake-air passage and that of a combustion chamber on one hand and an air-fuel ratio on the other.

FIG. 3 shows the relationship between the ratio of the air-fuel mixture in the vicinity of the ignition plug 14 and the ratio between the volumes $V_{IN}$, $V_{COM}$. The ratio of the amount of the fuel supplied from the fuel injection nozzle 10 to the amount of the air drawn into the combustion chamber 13 is 1:16, i.e., the air-fuel mixture has an air-fuel ratio A/F of 16.

Referring to FIG. 3, a volume ratio $V_{IN}/V_{COM}$ of 0.2 is attained when the fuel injection nozzle 10 is disposed just upstream of the intake valve 15. In this case, the air-fuel ratio A/F of the mixture in the vicinity of the ignition plug 14 is 19. When the volume ratio $V_{IN/V\text{-}COM}$ is close to 0.7, the air-fuel ratio A/F becomes 13, which is maintained to near a volume ratio $V_{IN}/V_{COM}$ of 1.2. On the other hand, the air-fuel ratio A/F increases as the volume ratio $V_{IN}/V_{COM}$ exceeds 1.2. When the volume ratio $V_{IN}/V_{COM}$ is above 1.8, the air-fuel ratio A/F maintains the value of 16.

As will be apparent from FIG. 3, in the case where the fuel injection nozzle 10 is disposed in the vicinity of the intake valve 15 as in the case of $V_{IN}/V_{COM}=0.2$, the fuel is drawn into the combustion chamber 13 at an early stage and not much is supplied to the vicinity of the ignition plug 14 in the combustion chamber 13.

As the position of the fuel injection nozzle 10 is moved toward the upstream side of the intake passages 5, the air-fuel ratio of the mixture in the vicinity of the ignition plug 14 in the combustion chamber 13 decreases, and an optimum condition for minimizing the air-fuel ratio is obtained when the volume ratio ranges between 0.7 and 1.2.

The invention has been described hereinbefore through the embodiment shown in FIG. 1 wherein the fuel is simultaneously supplied from the fuel injection nozzles 10 to all the intake-air passages 5. Now, another preferred embodiment of the invention will be described hereinunder with reference to FIG. 4 wherein the fuel is supplied in synchronism with the intake stroke in the cylinder corresponding to each fuel injection nozzle.

Figure 4:
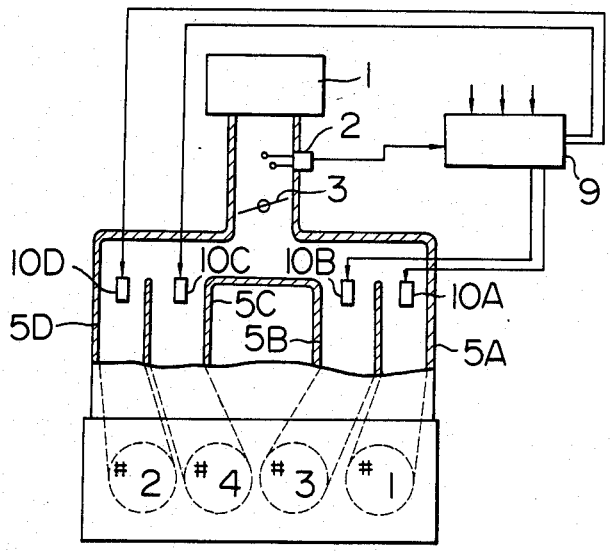
FIG. 4 is an illustration of the arrangement of fuel supply system for internal-combustion engine in accordance with another preferred embodiment of the invention.

In FIG. 4, the first cylinder #1 is connected with an intake-air passage 5A and a fuel injection nozzle 10A. In the similar manner, the third cylinder #3, the fourth cylinder #4 and the second cylinder #2 are connected with intake-air passages 5B, 5C, 5D and fuel injection nozzles 10B, 10C, 10D, respectively. In this case, the ratio between the volume $V_{IN}$ of each of the intake-air passages 10A thru 10D between the fuel injection nozzles 10A thru 10D and the intake valves 15, respectively, and the volume $V_{COM}$ of each of the combustion chambers have a relationship therebetween satisfying the following condition: $V_{IN}/V_{COM}=0.7$ to 1.2, as described above.

Figure 5:
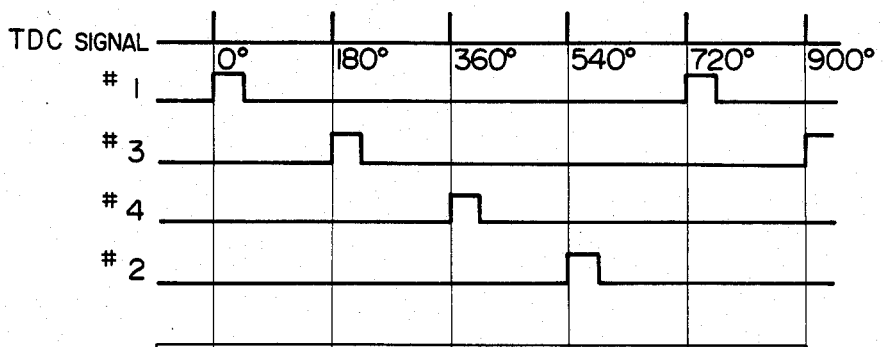
FIG. 5 shows the relationship between an injection signal in the fuel supply system shown in FIG. 4 and the stroke in each of combustion chambers.

Moreover, the TDC signal is delivered every 180° in crank angle as shown in FIG. 5. First, when the TDC signal corresponding to the first cylinder #1 is delivered, a valve-opening signal is applied to the fuel injection nozzle 10A corresponding to the first cylinder #1. Then, each time the crank rotates 180°, an valveopening signal is successively applied to the fuel injection nozzles 10B, 10C and 10D corresponding to the third cylinder #3, the fourth cylinder #4 and the second cylinder #2, respectively. Each valve-opening signal is generated in synchronism with the intake stroke of the corresponding cylinder.

Consequently, as the first cylinder #1 enters into the intake stroke, for example, the fuel is supplied thereto from the fuel injection nozzle 10A, and in this case, the air closer to the intake valve 15 is drawn into the combustion chamber 13 at an early stage and thereafter, the air containing the fuel supplied from the fuel injection nozzle 10A is drawn therein. Therefore, a rich air-fuel mixture is concentrated on the vicinity of the ignition plug 14 in the combustion chamber 13. Then, in the similar manner, a rich air-fuel mixture is concentrated on the vicinity of the ignition plug 14 in the combustion chamber 13 of each of the third cylinder #3, the fourth cylinder #4 and the second cylinder #2.

It is to be noted that, in the embodiments shown in FIGS. 1 and 4, it is desirable that the fuel supplied from the fuel injection nozzle should be atomized as much as possible. Means for atomizing the fuel will be described with reference to FIGS. 6 and 7.

Figure 6:
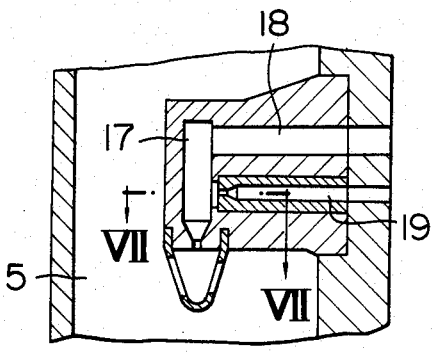
FIG. 6 is an illustration of the arrangement of a fuel injection nozzle employed in the invention.
Figure 7:
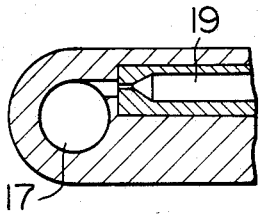
FIG. 7 is a sectional view taken along a line A—A of FIG. 6.

In FIGS. 6 and 7, the fuel injection nozzle 10 comprises a longitudinal passage 17 opened in the direction of flow of the air in the intake-air passage 5, a fuel passage 18 for supplying the fuel and an air passage 19 for supplying air perpendicularly to the longitudinal passage 17 and tangentially to the periphery thereof.

Accordingly, the fuel flowing through the longitudinal passage 17 is made to swirl by the tangential flow of the air and is jetted out into the intake-air passage 5 to effectively atomize the fuel.

As will be fully understood from the foregoing description, the invention permits a richer air-fuel mixture to be supplied to the vicinity of the ignition plug without necessitating any auxiliary combustion chamber and any air-fuel mixture supply means therefor which are conventionally required.

Although the invention has been described through specific terms, it is to be noted here that the described embodiments are not exclusive and various changes and modifications may be imparted thereto without departing from the scope of the invention which is limited solely by the appended claims.

What is claimed is:

1. A fuel supply system for an internal-combustion engine, the fuel supply system comprising:

fuel supply means;

an intake-air passage connected through an intake valve to a combustion chamber defined by a cylinder and a piston, said intake-air passage having a volume between the fuel supply means and the intake valve means equal to a volume of the cylinder at a lowest point of a stroke of the piston, wherein the fuel supply means is disposed in a portion of said intake-air passage at such a position that the relationship between a volume $V_{IN}$ of said intake-air passage extending from the fuel supply means to said intake valve and a volume $V_{COM}$ of said combustion chamber determined at the lowest point of the stroke of the piston satisfies the following condition:

$$V_{IN}=0.7 \text{ to } 1.2\ V_{COM}$$

whereby air present between a vicinity of the intake valve and the fuel supply means is sucked in in accordance with a progress of the intake stroke of the internal combustion engine, with the fuel supplied by the fuel supply means being concentrated at an end of the intake stroke in a vicinity of an ignition plug disposed in an upper part of the cylinder.

2. A fuel supply system for an internal-combustion engine according to claim 1, wherein said fuel supply means includes a fuel injection nozzle adapted to input a fuel when said piston enters into the intake stroke.

3. A fuel supply system for an internal-combustion engine according to claim 1, wherein said internal-combustion engine includes a plurality of combustion chambers connected with respective intake-air passages, each of the intake-air passages includes a fuel supply means disposed at positions satisfying the condition: $V_{IN}=0.7$ to $1.2\ V_{COM}$.

4. A fuel supply system for internal-combustion engine according to claim 3, wherein said fuel supply means are fuel injection nozzles adapted to simultaneously input a fuel when one of said pistons enters into the intake stroke.

5. A fuel supply system for internal-combustion engine according to claim 3, wherein said fuel supply means are fuel injection nozzles each adapted to inject a fuel in synchronism with the intake stroke of the associated piston.

* * * * *